United States Patent [19]

Brull et al.

[11] Patent Number: 4,648,214

[45] Date of Patent: Mar. 10, 1987

[54] CRYOGEN SHOT BLAST DEFLASHING SYSTEM

[75] Inventors: John J. Brull; Robert E. Schmitz, both of Chagrin Falls, Ohio

[73] Assignee: AGA Ab, Sweden

[21] Appl. No.: 546,431

[22] Filed: Oct. 28, 1983

[51] Int. Cl.[4] ..... B24C 3/04

[52] U.S. Cl. ..... 51/410; 51/423; 51/425

[58] Field of Search ..... 51/423, 422, 410, 425, 51/163.1, 164.1, 314, 426, 424, 319–321

[56] References Cited

U.S. PATENT DOCUMENTS

| | | | |
|---|---|---|---|
| Re. 25,554 | 4/1964 | Leliaert . | |
| Re. 30,977 | 6/1982 | Zecher | 51/422 |
| B.311,910 | 1/1975 | Schmidt et al. | 51/314 |
| 782,700 | 2/1905 | Rusby . | |
| 821,483 | 5/1906 | Graham . | |
| 965,813 | 7/1910 | Greist . | |
| 1,460,731 | 7/1923 | Pickop . | |
| 1,678,072 | 5/1928 | Neville . | |
| 2,116,160 | 5/1938 | Rosenberger et al. | 51/423 |
| 2,351,453 | 6/1944 | Pearl | 51/422 |
| 2,380,653 | 7/1945 | Kopplin | 51/282 |
| 2,476,540 | 7/1949 | Fraser | 51/282 |
| 2,499,359 | 3/1950 | Cox, Jr. . | |
| 2,509,041 | 5/1950 | Lubenow | 51/164 |
| 2,533,653 | 12/1950 | Winkeljohn | 51/282 |
| 2,600,282 | 6/1952 | Strong | 51/164 |
| 2,682,732 | 7/1954 | Hanrahan et al. | 51/164 |
| 2,881,571 | 4/1959 | Granata | 51/164 |
| 2,996,846 | 8/1961 | Leliaert . | |
| 3,041,787 | 7/1962 | Schnetzer . | |
| 3,086,278 | 4/1963 | Fuchs | 51/164.1 |
| 3,110,983 | 11/1963 | Moore . | |
| 3,137,101 | 6/1964 | Leliaert . | |
| 3,160,993 | 12/1964 | McCormick, Jr. . | |

List Continued on next page.

FOREIGN PATENT DOCUMENTS

| | | | |
|---|---|---|---|
| 0231814 | 3/1911 | Fed. Rep. of Germany | 51/422 |
| 0096778 | 6/1982 | Japan | 51/422 |

OTHER PUBLICATIONS

*Ultrabound Deflashing Machine of the Last Generation,* published by Rutital of Varese, Italy, data unknown, total of 8 pages.

*Primary Examiner*—Roscoe V. Parker
*Assistant Examiner*—Robert A. Rose
*Attorney, Agent, or Firm*—David A. Burge

[57] ABSTRACT

A cryogen shot blast deflashing apparatus includes an upstanding frame which movably supports a receptacle assembly. The receptacle assembly includes an enclosure having a housing that enshrouds a rotatable drum, and a door which selectively opens and closes an open outer end of the drum. A throwing wheel is carried on the door for discharging particulate media and cryogen gas into the drum for impacting workpieces embrittling workpiece flash. A recirculation system is provided for withdrawing cryogen gas and particulates from the drum during operation of the machine, for separating reusable particulate media from particles of waste material such as workpiece flash, and for returning a controlled flow of pressurized cryogen gas and particulate media to the throwing wheel. The recirculation system includes a blower for recirculating cryogen gas to the throwing wheel from the drum by evacuating cryogen from the drum through a return conduit, and by redelivering pressurized cryogen to the throwing wheel through a supply conduit, whereby the blower cooperates with the throwing wheel to establish the desired high velocity flow of cryogen gas through the drum. A metering device introduces a controlled flow of media into the flow of cryogen being ducted to the throwing wheel. Versatility is enhanced by providing means for adjusting the pattern of discharge, the speeds of rotation of the drum, the blower and/or the throwing wheel, the temperature and/or orientation of the treatment chamber, and/or the flow rate.

20 Claims, 12 Drawing Figures

U.S. PATENT DOCUMENTS

| | | | |
|---|---|---|---|
| 3,276,219 | 10/1966 | Leliaert . | |
| 3,279,125 | 10/1966 | Leliaert . | |
| 3,284,958 | 11/1966 | McCormick, Jr. . | |
| 3,298,138 | 1/1967 | McCormick, Jr. . | |
| 3,313,067 | 4/1967 | Smith et al. | 51/320 |
| 3,333,367 | 8/1967 | Salvaire . | |
| 3,432,968 | 3/1969 | Croft et al. . | |
| 3,468,077 | 9/1969 | Jones et al. | 51/314 |
| 3,473,268 | 10/1969 | Graf et al. | 51/422 |
| 3,528,201 | 9/1970 | Jones et al. | 51/164 |
| 3,589,080 | 6/1971 | Abbey | 51/314 |
| 3,676,963 | 7/1972 | Rice et al. | 51/320 |
| 3,702,519 | 11/1972 | Rice et al. | 51/310 |
| 3,728,825 | 4/1973 | Barrett, Jr. | 51/164 |
| 3,767,096 | 10/1973 | Coscia | 51/164 |
| 3,824,739 | 7/1974 | Moret et al. | 51/426 |
| 3,827,186 | 8/1974 | Ehnot | 51/6 |
| 3,909,988 | 10/1975 | Kerwin et al. | 51/163 |
| 3,924,357 | 12/1975 | Schmidt et al. | 51/164 |
| 4,011,691 | 3/1977 | Grund | 51/164 |
| 4,030,247 | 6/1977 | Grund et al. | 51/419 |
| 4,037,368 | 7/1977 | Kerwin et al. | 51/164 |
| 4,128,197 | 12/1978 | Ischenko et al. | 51/164 |
| 4,164,103 | 8/1979 | Hesse et al. | 51/417 |
| 4,312,156 | 1/1982 | McWhorter | 51/418 |
| 4,355,488 | 10/1982 | Schmitz et al. | 51/319 |

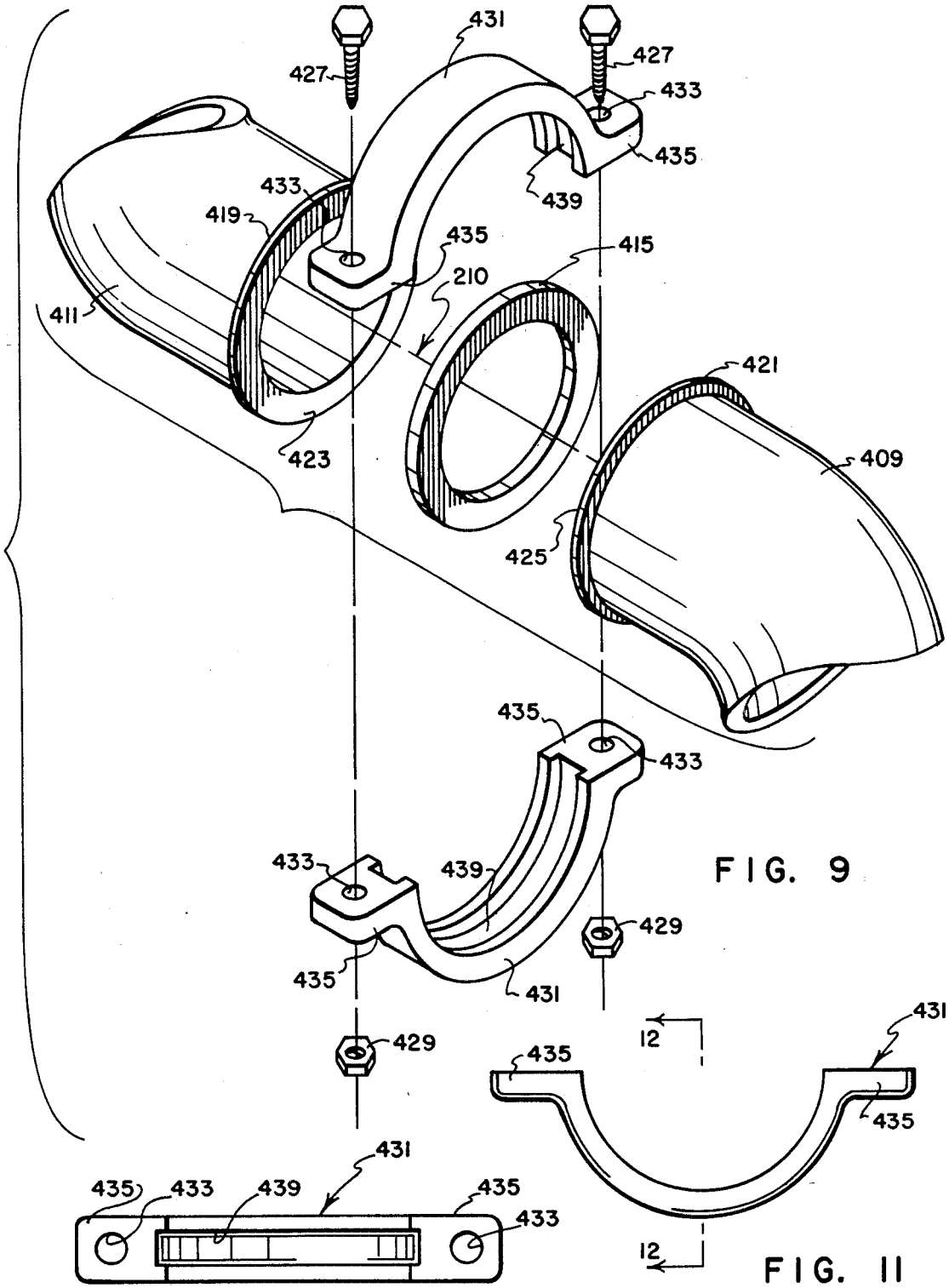
FIG. 9
FIG. 10
FIG. 11
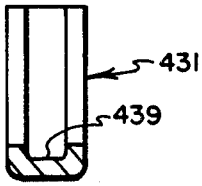
FIG. 12

CRYOGEN SHOT BLAST DEFLASHING SYSTEM

CROSS-REFERENCE TO RELATED APPLICATIONS

The following concurrently-filed applications relate to concurrently developed aspects of the system described herein, which aspects resulted from the contributions of different joint inventive entities:

CRYOGEN SHOT BLAST DEFLASHING SYSTEM WITH JOINTED SUPPLY CONDUIT, filed Oct. 28, 1983, Ser. No. 546,429, by John J. Brull and Michael T. Carnahan, issued May 28, 1985 as U.S. Pat. No. 4,519,812, hereinafter referred to as the "Jointed Supply Conduit Case;" and, CRYOGEN SHOT BLAST DEFLASHING SYSTEM WITH BELLOWS RETURN CONDUIT, filed Oct. 28, 1983, Ser. No. 546,430, by Gilbert J. Vasek, hereinafter referred to as the "Bellows Return Conduit Case."

BACKGROUND OF THE INVENTION

1. Field of the Invention

The present invention relates generally to a novel and improved system for removing flash from workpieces which have been molded from such flexible materials as rubber, plastics, and the like. More particularly, the present invention relates to a cryogen shot blast deflashing system which, in its preferred form, (1) moves workpieces to be deflashed about in a treatment chamber, (2) exposes the workpieces in the treatment chamber to a high velocity flow of cryogen gas to rapidly embrittle workpiece flash, (3) impacts workpieces in the treatment chamber with particulate media which is projected from a throwing wheel to remove embrittled flash from the workpieces, (4) recirculates cryogen gas and particulate media from and to the treatment chamber in a highly efficient manner, and (5) utilizes a recirculating flow of pressurized cryogen gas to act as a carrier for particulate media being delivered to the throwing wheel.

2. Prior Art

When articles are molded from flexible materials such as rubber, plastics and the like, the resulting articles often have thin pieces of unwanted flexible material extending therefrom called "flash" which must be removed to conform the articles to their desired final configurations. Removing flash from articles formed from flexible materials is difficult in view of the soft, elastic nature of the flexible materials. While various types of mechanical trimming operations have been proposed for use in extricating unwanted flash, these proposals have proven not to be economically feasible in a majority of applications.

In order to simplify and reduce the cost of flash removal, proposals of various types have been made for "freezing" or otherwise cooling molded articles to embrittle their thin sections of flash, whereafter one or a combination of mechanical processes have been utilized to break off, trim or otherwise remove the "frozen" or embrittled flash. Some of these proposals have utilized a two-stage process wherein workpieces to be deflashed are cooled in a first stage to effect flash embrittlement, whereafter the cooled workpieces are vibrated, tumbled or otherwise mechanically treated in a second stage to break away or otherwise remove the embrittled flash.

Two-stage treatment processes of this type are undesirable from several viewpoints. They are time consuming to carry out because cooling the workpieces and removing their flash comprise separate steps that are carried out sequentially rather than concurrently. Inasmuch as the workpieces are cooled only once and will not be cooled again at other stages during the flash removal procedure, adequate time must be devoted at the outset to providing a thorough cooling of the workpieces to assure that they are refrigerated to an extent that their flash will remain embrittled throughout the remainder of the flash removal process. Sometimes the extensive degree of refrigeration which is required at the outset of such a two-stage process results in the generation of undesirable stresses and/or the formation of cracks or other types of structural defects in the workpieces.

An equally troublesome drawback of these two-stage processes is that, if there is a relatively large quantity of flash to be removed, the degree of refrigeration provided in the initial cooling stage may not be sufficient to keep the workpieces adequately embrittled during the entire time required for deflashing. Where such is the case, when the two-stage process has drawn to a close, the workpieces have not been properly deflashed.

The use of cryogen materials such as liquid nitrogen to effect embrittlement of workpiece flash is known. As utilized herein, the term "cryogen" will be understood to refer broadly to substances which are fluids and are at temperatures of about −60° F. and below.

The use of shot blast deflashing machinery in single and plural stage processes to remove cryogen-embrittled flash is known. Previous proposals for cryogen shot blast deflashing apparatus have been characterized by a number of drawbacks. Proposed apparatus typically have been of complex and expensive construction, and have exhibited less than the desired degree of reliability. Such systems as have been proposed for (1) withdrawing particulates including media and pieces of flash from treatment chambers, (2) segregating reusable media, and (3) returning the reusable media to throwing wheels have not functioned entirely satisfactorily. Apparatus embodying a number of previous proposals have encountered problems of clogged and/or "frozen" flow lines and valves. In short, most previously proposed cryogen shot blast deflashing apparatus have been quite costly to build, costly to maintain, and costly to operate; moreover, their operation has been undependable in that it has been characterized by undesirably frequent and lengthy intervals of machine "down time."

Still other drawbacks of previously proposed cryogen shot blast deflashing systems have related to the inabilities of these systems to provide for adequate adjustment of various operating parameters throughout sufficiently wide ranges of control so that a needed variety of shot blast deflashing operations can be performed. Stated in another way, previously proposed apparatus have suffered from a pronounced lack of versatility.

3. The Referenced Applications

The referenced applications relate to system features which were developed concurrently with the system features which form the subject matter of the present application, but which were developed by different joint inventive entities. In preferred practice, the features of the present and the referenced applications are utilized in a single system. However, inasmuch as the features claimed in all three concurrently-filed applications may be utilized independently and thus constitute separate inventions, separate applications are being filed with each of the applications having a clear line of demarcation from the subjects matter of the other applications.

The referenced Jointed Supply Conduit Case relates to the use of a jointed conduit in a cryogen deflashing system wherein relatively movable conduit portions are configured to pivot about an axis which is also utilized by associated relatively movable machine components, whereby the conduit portions and the machine components may move in unison in a particularly advantageous manner. The referenced Bellows Return Conduit Case relates to the use of an accordian-like bellows structure in a cryogen deflashing system to enable relatively movable machine components to be communicated for transfer of fluids, media and the like therebetween.

SUMMARY OF THE INVENTION

The present invention overcomes the foregoing and other drawbacks of the prior art by addressing the foregoing and other needs through the provision of a novel and improved cryogen shot blast deflashing system which is efficient and reliable in operation, and which is controllable and adjustable throughout wide ranges of operating parameters thereby enabling the system to properly conduct a wide variety of shot blast deflashing operations. In preferred practice, apparatus embodying the invention defines a closed system that minimizes the escape and waste of cryogen, and maintains a cryogen atmosphere throughout the system to prevent the entry, condensation and freezing of moisture from ambient air whereby the cost of operating the unit is kept at a minimum as is machine down time.

An advantageous feature of the system of the present invention resides in its utilization of a high velocity flow of recirculating cryogen gas not only (1) to reliably deliver an accurately metered flow of particulate media to a throwing wheel, but also (2) to establish a high cooling rate within the workpiece treatment chamber for rapidly embrittling workpiece flash by enhancing the convective heat transfer coefficient and for maintaining flash in a thoroughly embrittled state throughout the deflashing process. A further feature of the system is its use of a common supply conduit to duct a high velocity flow of cryogen gas and particulate media to a throwing wheel as a part of a recirculating procedure that effectively recirculates and reuses both cryogen gas and particulate media during operation of the system. By establishing a high velocity flow cryogen gas through the treatment chamber, a significantly enhanced chill factor is brought into play to speed embrittlement of workpiece flash.

The utilization of a single supply conduit to return recirculated cryogen gas and particulate media through a throwing wheel to a treatment chamber is typical of many simplifications and improvements provided systems which incorporate the described preferred practice of the present invention. These advances not only reduce cost but also enhance reliability and other performance characteristics.

In accordance with the preferred practice of the invention, an upstanding frame supports a receptacle assembly which includes an enclosure that at least partially enshrouds a rotatable drum. The drum defines a treatment chamber, and has an access opening for charging workpieces into and removing workpieces from the drum. The enclosure also includes a door which is pivotally mounted on the housing for movement between positions wherein the door selectively opens and closes the access opening. The door carries a throwing wheel for projecting particulate media into the drum to impact contents of the drum. A recirculating system is provided for withdrawing cryogen gas and particulate materials from the drum during operation of the machine, for segregating reusable particulate media from other withdrawn particulates such as pieces of flash, and for returning a mixture of pressurized cryogen gas and particulate media through a supply conduit to the throwing wheel.

In order to provide a system which not only minimizes the escape of cryogen during system operation, but which enables particulate media and cryogen gas to be withdrawn readily from the workpiece treatment chamber for recirculation, a closed, cryogen-containing system is employed. In preferred practice, a receptacle assembly includes an enclosure having a housing and a door which cooperate to totally enshroud a rotating drum that defines the workpiece treatment chamber. The enclosure preferably provides a closed compartment within which the drum rotates, but, as an alternative, can cooperate with the drum to define a closed compartment extending about only a portion of the drum. Screened openings are formed through the outer wall of the drum to permit cryogen gas and particulate to discharge from the drum into the closed compartment. The structure which defines the openings also serves to engage workpieces within the drum and to assist in churning the workpieces about during a deflashing operation so that workpiece flash is properly exposed to impact by media discharged from the throwing wheel. A flexible, bellows-like conduit is preferably utilized to duct withdrawn particulate from the closed compartment of the receptacle assembly to a vibratory separator. The separator segregates reusable particulate media from other particulate materials such as pieces of flash. The reusable particulate media is ducted to a supply hopper, while other withdrawn particulates are delivered to a waste bin. A metering device introduces a controlled flow of particulate media from the supply hopper into the supply conduit which is used to duct a high velocity flow of cryogen to the throwing wheel. Even the media supply hopper and the waste bin are, in preferred practice, part of the closed system.

An advantage of providing a closed cryogen-containing system is that moisture is prevented from entering the system and accumulating in the form of ice which blocks flows through conduits or otherwise inhibits proper operation of the system. By maintaining a cryogen-filled, i.e., air-purged, environment throughout the system, even when the treatment chamber is opened briefly to receive or discharge workpieces, very little ambient moisture is found to enter the system, whereby machine "down time" due to moisture accumulation is minimized if not eliminated.

In order to enhance system versatility, means are preferably provided for adjusting several operating parameters. The operation of the metering device which delivers particulate media into the supply conduit is controllable so that the rates of flow at which particulate media are delivered to the throwing wheel can be controlled within a wide range of adjustment. The speed of rotation of the throwing wheel, and the direction and pattern at which particulate media are projected into the workpiece treatment chamber may be controlled to provide exactly the type of impact which may be desired for removing flash from particular types of workpieces. Likewise, the speed of rotation and the orientation of the drum are controllable, whereby the manner in which workpieces are caused to tumble about in the drum can be controlled. Still further, by changing the type, shape and size of the particulate media being used, as well as the temperature of the cryogen environment within the treatment chamber, the operation of the system can be further customized to accommodate the type of deflashing action to be provided for particular types of workpieces.

BRIEF DESCRIPTION OF THE DRAWINGS

These and other features and a fuller understanding of the invention may be had by referring to the following description and claims, taken in conjunction with the accompanying drawings, wherein:

FIG. 9 is an exploded perspective view of components of a supply line joint utilized in preferred practice;

FIGS. 10 and 11 are top plan and side elevational views, respectively, of a component of the supply line joint; and, FIG. 12 is a sectional view as seen from a plane indicated by a line 12—12 in FIG. 11.

DESCRIPTION OF THE PREFERRED EMBODIMENT

Figure 1:
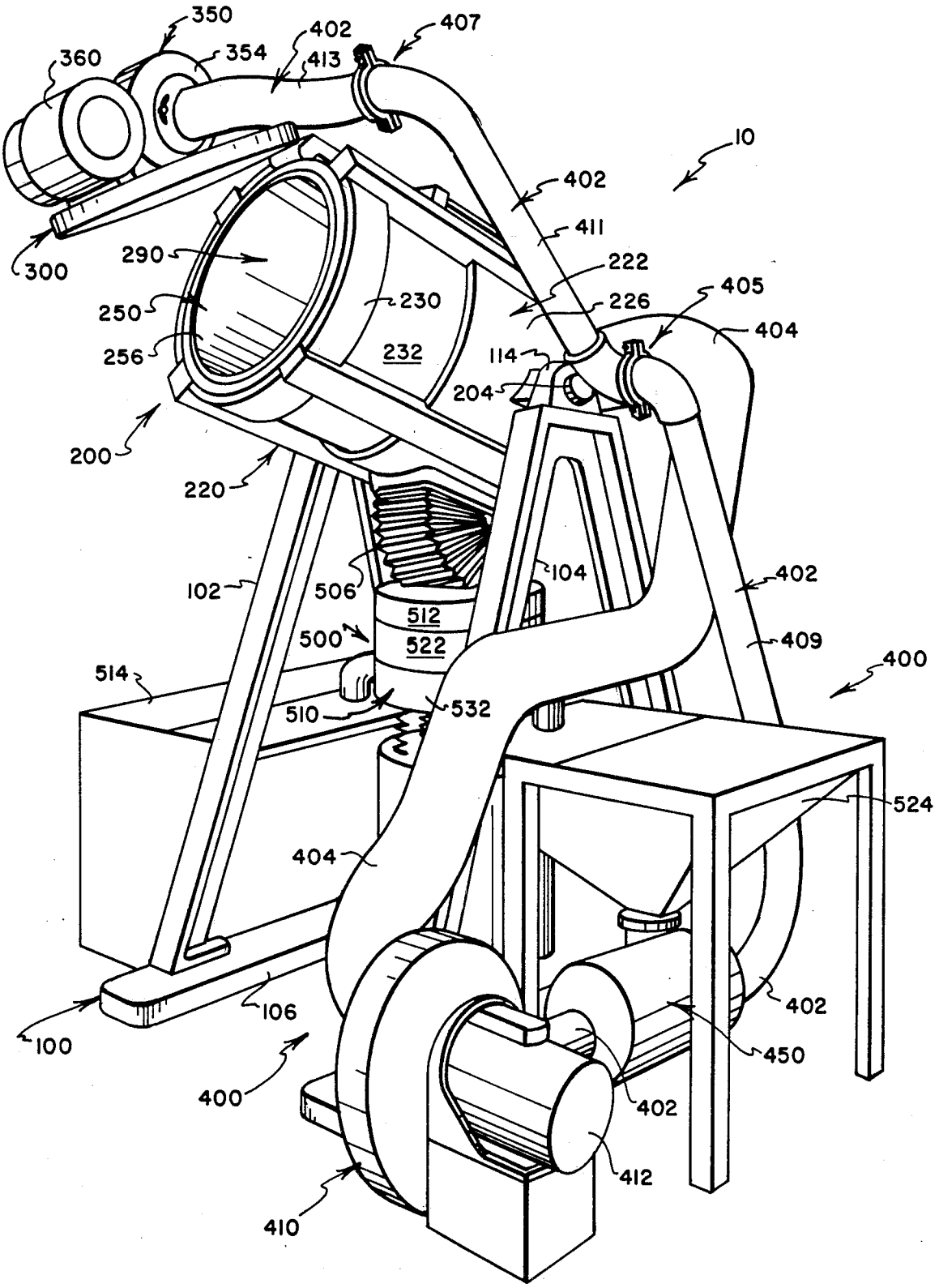
FIG. 1 is a perspective view of a cryogen shot blast deflashing machine incorporating the preferred practice of the present invention, with the machine having its treatment receptacle in an upwardly oriented position with its door open to receive workpieces to be deflashed.

Referring to FIGS. 1–6, a cryogen shot blast deflashing apparatus incorporating the preferred practice of the present invention is indicated generally by the numeral 10. The apparatus 10 includes an upstanding frame structure indicated generally by the numeral 100, a workpiece treatment receptacle assembly indicated generally by the numeral 200, and a supply and recirculation system indicated generally by the numeral 400.

Figure 5:
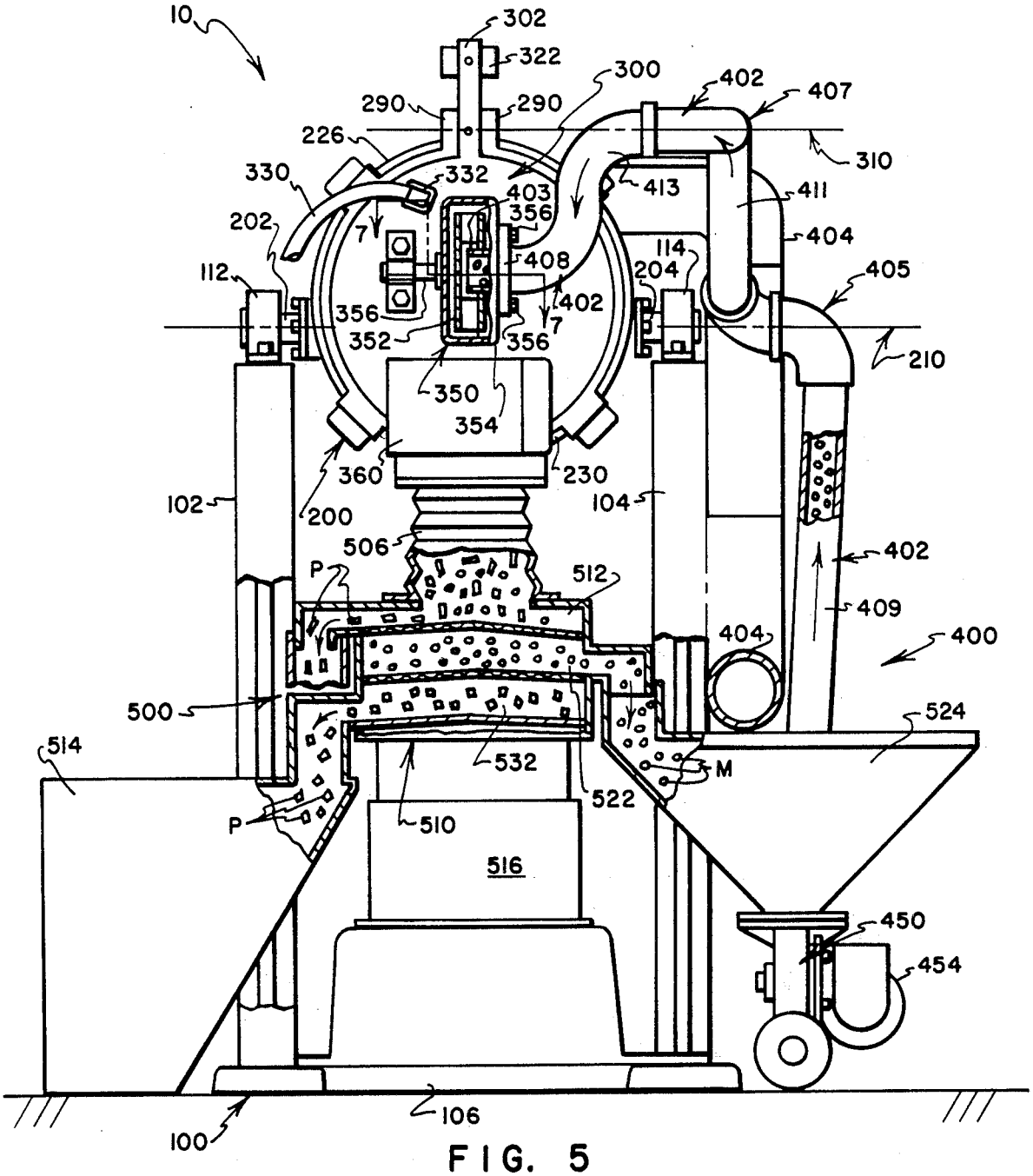
FIG. 5 is a front end elevational view of the machine with the machine's treatment receptacle oriented substantially horizontally, and with portions of the machine removed or broken away and shown in cross section.

The frame structure 100 includes a pair of upstanding A-frame members 102, 104 which are interconnected by a U-shaped base member 106. Bearing block assemblies 112, 114 are carried atop the A-frame members 102, 104. The receptacle assembly 200 has stub shafts 202, 204 which project from opposite sides thereof and are journalled by the bearing block assemblies 112, 114 to mount the receptacle assembly 200 for movement about a horizontal pivot axis which is indicated in FIG. 5 by the numeral 210.

Figure 2:
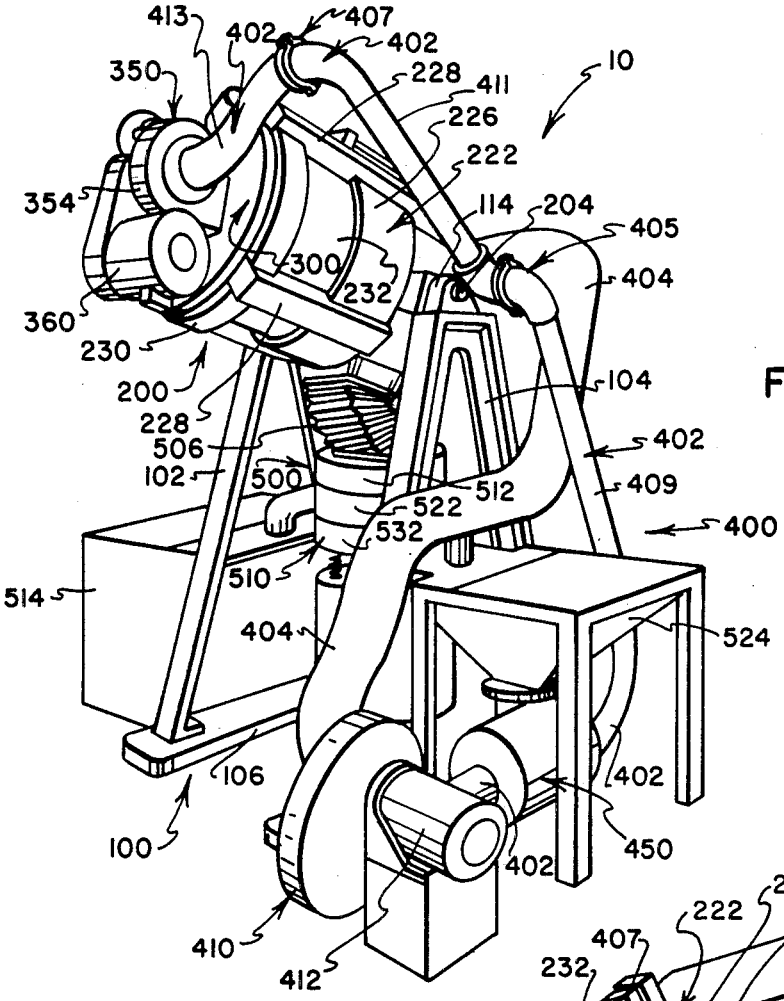
FIG. 2 is a perspective view similar to FIG. 1, but on a reduced scale and showing the door closed as it is during a deflashing operation.
Figure 3:
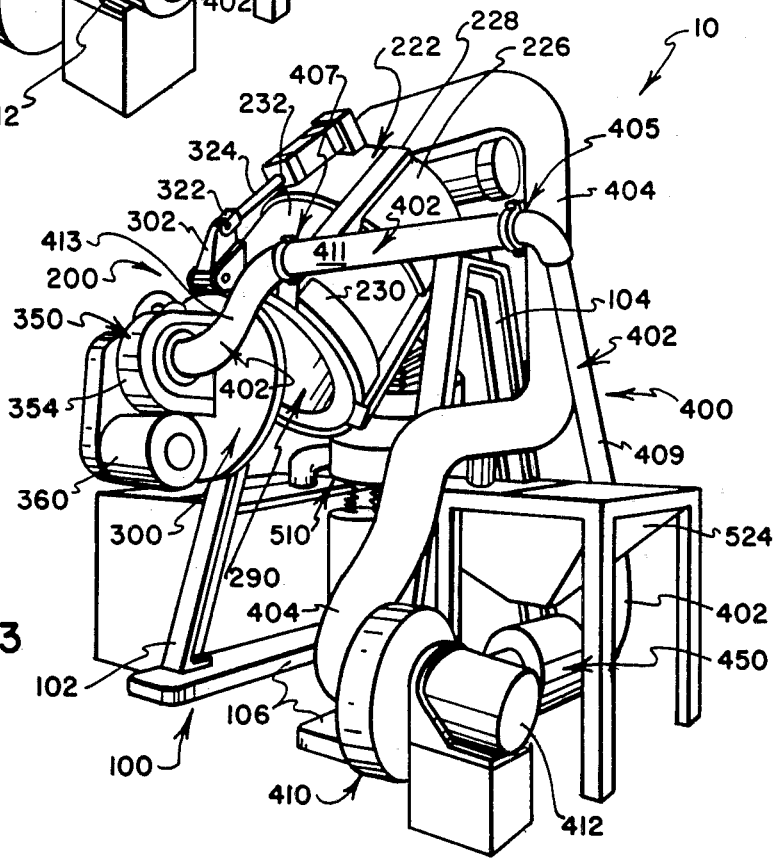
FIG. 3 is a perspective view similar to FIG. 2 but with the machine's treatment receptacle in a downwardly oriented position and with its door open for discharging deflashed workpieces.
Figure 4:
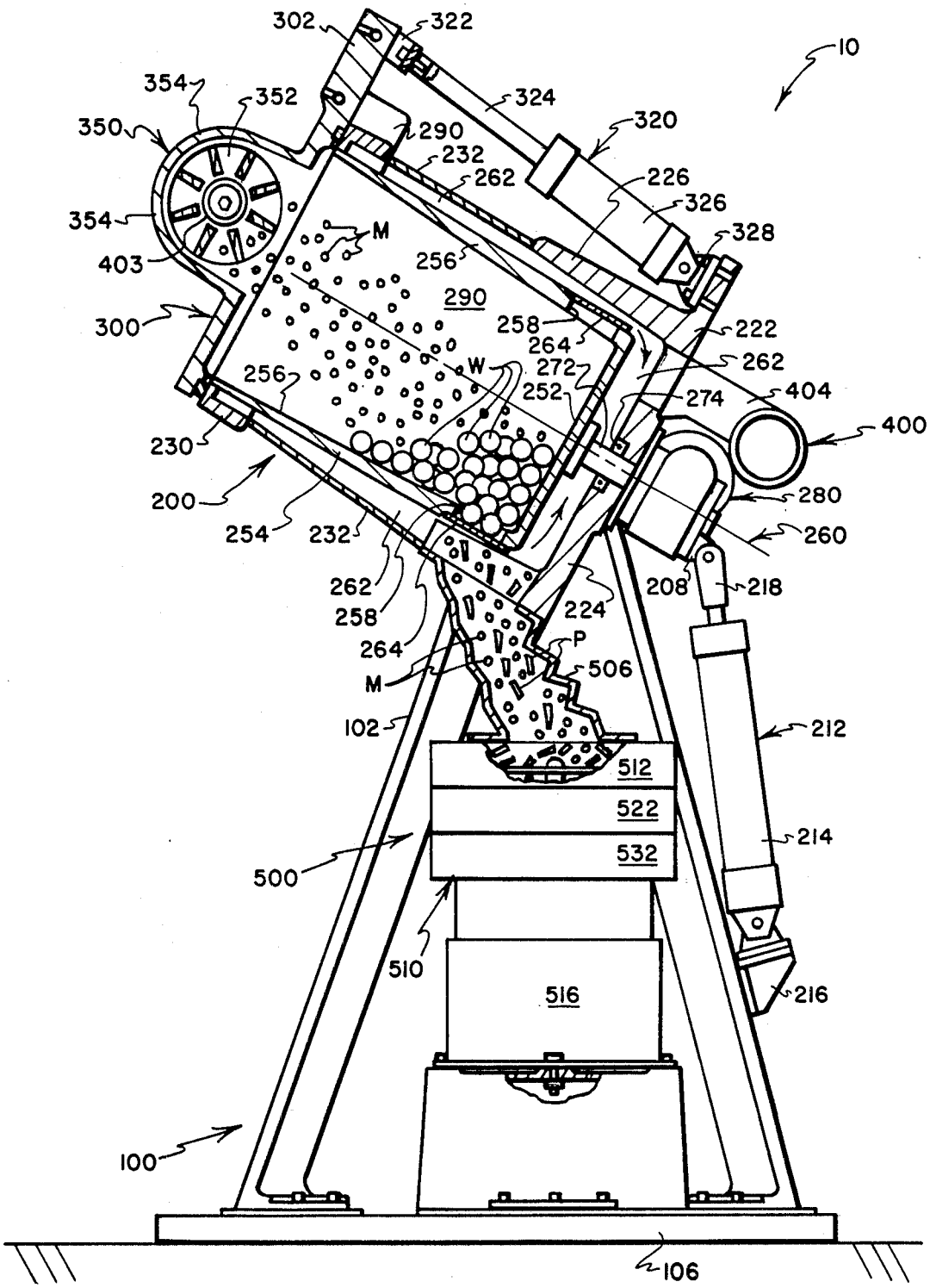
FIG. 4 is a side elevational view of the machine with its treatment receptacle oriented upwardly and with its door closed, and with portions of the machine removed or broken away and shown in cross section to illustrate operation of certain portions of the machine during a deflashing cycle.

As is best seen in FIG. 4, a pneumatic cylinder 212 is interposed between the frame structure 100 and the receptacle assembly 200 to pivot the receptacle assembly 200 about the pivot axis 210 (see FIG. 5 wherein the axis 210 is indicated by a center line, and FIG. 6 wherein the axis 210 is indicated by a point) between an upwardly oriented position, as shown in FIGS. 1, 2, 4 and 6, and a downwardly oriented position, as shown in FIG. 3. The cylinder 212 can also position the receptacle assembly 200 at intermediate positions, one of which is illustrated in FIG. 5. The cylinder 212 includes a body 214 which is pivotally connected to a bracket 216 that is secured to the A-frame member 102. The cylinder 212 has a ram 218 that is pivotally connected to a positioning arm 208 that is rigidly connected to the receptacle assembly 200.

The receptacle assembly 200 includes a housing structure 220 which forms part of an enclosure that enshrouds a drum 250. The drum 250 is rotatable about an axis 260 and defines a treatment chamber 290 within which workpieces to be deflashed may be positioned so that a deflashing operation can be carried out in a cryogenic environment which is established within the treatment chamber 290 as will be explained.

The housing structure 220 includes a base casting 222 which has a back wall 224 and a generally cylindrical side wall 226 that circumferentially surrounds a rearward end region of the drum 250. A plurality of cast arms 228 extend forwardly from the base casting 222 and support an annular front casting 230 that surrounds a forward open end region of the drum 250. A cylindrical shroud 232 bridges the spaces between the castings 222, 230 to complete the formation of an enclosure that surrounds side and rear wall portions of the drum 250 to define a closed compartment 262 about the drum 250, as is seen in FIG. 4.

Referring to FIG. 4, a stub shaft 272 and a bearing assembly 274 are carried respectively by the end wall 252 of the drum 250 and the back wall 224 of the housing structure 220, whereby the drum 250 is supported in a cantilevered fashion and is journaled for rotation about the axis 260. A variable speed drive motor assembly 280 is carried on the back wall 224 of the housing structure 220 and drivingly connects with the stub shaft 272 to rotate the drum 250 at selected speeds of rotation. If desired, the annular front casting 222 may be provided with an annular bearing (not shown) which surrounds the outer end region of the drum 250 and also assists in supporting the drum 250 for rotation about the axis 260.

The majority of the drum 250 is formed by a single casting 254 which defines the end wall 252 and a cylindrical side wall 256. Openings 258 are formed at spaced intervals through the side wall 256, and are covered by screens 264 for permitting particulates and cryogen gas to escape from the treatment chamber 290 into the closed compartment 262 which is defined about the drum 250. The wall structure which defines the openings 258 also serve the function of engaging workpieces in the drum 250 as the drum rotates, to help churn the workpieces about in the treatment chamber 290. As is seen in FIG. 4, workpieces W to be deflashed tend to congregate near the lower rear juncture of the side wall 256 and the end wall 252, and as one of the screened openings 258 passes by the congregation of workpieces W during rotation of the drum 250, some of the workpieces W are engaged by the drum structure surrounding the opening 258 and are caused to move with the rotating drum 250 to facilitate tumbling of the workpiece W.

Referring again to FIGS. 1–6, the receptacle assembly 200 also includes a door 300 for selectively opening and closing the open end of the drum 250 to selectively provide and preclude access to the treatment chamber 290. As is best seen in FIGS. 3, 4 and 5, the door 300 has an operating arm 302 which extends between and is pivotally connected to a pair of spaced upstanding ears 290. The ears 290 project upwardly from and are rigidly connected to the housing structure 220. A pneumatic cylinder 320 is carried atop the housing structure 220 and has a yoke 322 carried at the end of an extensible ram 324. The cylinder 320 has a body 326 which is connected to a bracket 328 that is rigidly secured to the base casting 222. The yoke 322 connects with the operating arm 302 of the door 300 for pivoting the door 300 about an axis 310 (see FIG. 5 wherein the axis 310 is indicated by a center line, and FIG. 6 wherein the axis 310 is indicated by a point) between an open position, as shown in FIGS. 1 and 3, and a closed position, as shown in FIGS. 2, 4, 5 and 6.

Figure 7:
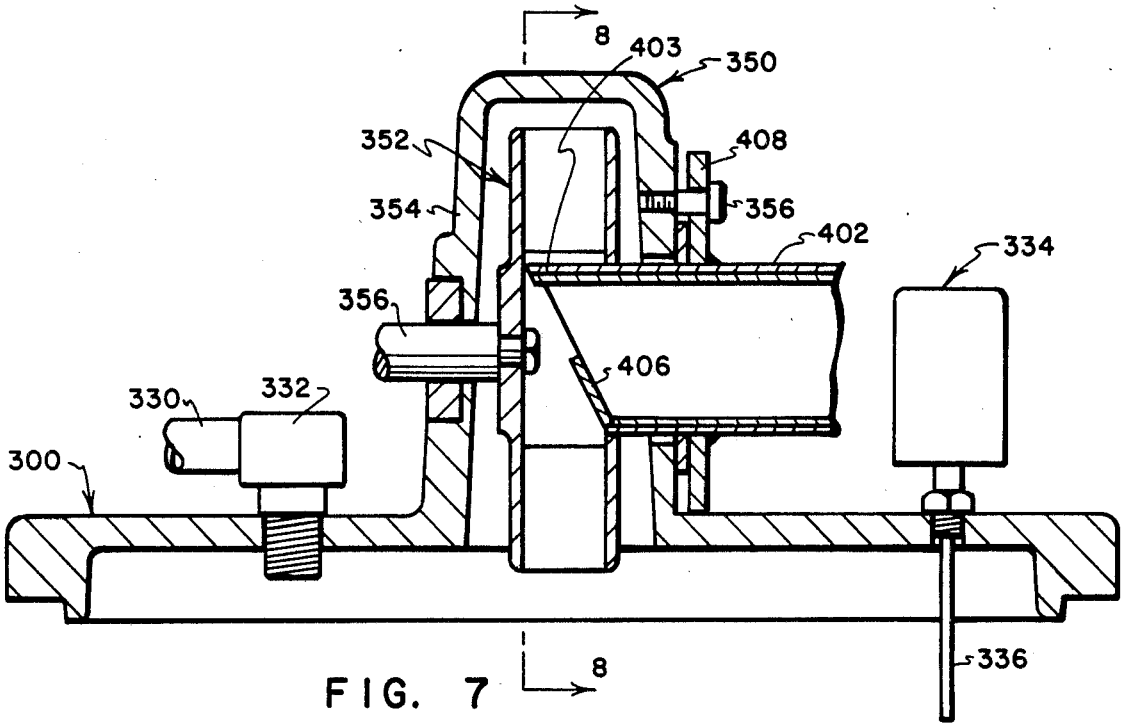
FIG. 7 is a sectional view, on an enlarged scale, as seen generally from planes indicated by a broken line 7—7 in FIG. 5.

Referring to FIGS. 5 and 7, a valved cryogen supply conduit 330 connects with a fitting 332 which is threaded through an opening provided in the door 300. The valved conduit 330 is connected to a source of pressurized cryogen (not shown) which is maintained at a temperature that is lower than such temperature as is desired to be maintained in the treatment chamber 290 during operation of the machine 10. The valved conduit 330 includes a conventional power-operated valve (not shown) for controlling the flow of cryogen into the treatment chamber 290 so that cryogen from the conduit 330 is added to the chamber 290 only when the temperature within the treatment chamber 290 is sensed as being higher than desired during a deflashing operation. As is also seen in FIG. 7, a transducer 334 is carried by the door 300 and has a portion 336 which projects into the treatment chamber 290 when the door 300 is closed to sense the temperature within the treatment chamber 290. The transducer 334 is commercially available from any of a number of manufacturers, and is selected to be of the type which will provide a signal that is representative of sensed temperature lying at least within a desired operating range of from about −250° F. to about −330° F.

A throwing wheel assembly 350 is carried on the door structure 300. As is best seen in FIGS. 4, 5, 7 and 8, the throwing wheel assembly 350 includes a vaned rotor 352 which is enclosed by a surrounding housing 354. A shaft 356 supports the rotor 352 for rotation, and is journaled by bearings (not shown) carried on the door 300. A variable speed motor 360 is carried on the door 300 and is drivingly connected to the shaft 356 for rotating the vaned rotor 352 at controlled speeds of operation.

Figure 8:
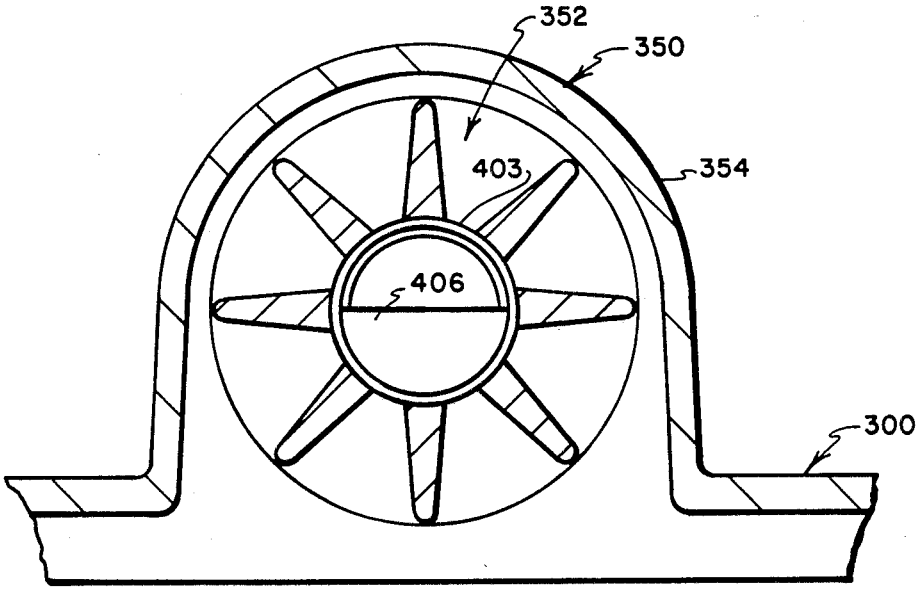
FIG. 8 is a sectional view as seen generally from a plane indicated by a 8—8 in FIG. 7.

Referring to FIGS. 5, 7 and 8, a supply conduit 402 has an end formation 403 which extends into the housing 354 to introduce a flow of cryogen gas and particulate media into a center region of the vaned rotor 352. Media and cryogen introduced through the conduit end formation 403 are caused to be projected outwardly under centrifugal force as the rotor 352 is turned by the motor 360. Thus, the throwing wheel 350 operates to direct a flow of particulate media and cryogen gas from the supply conduit 402 into the drum 250 for impacting contents of the treatment chamber 290.

Referring to FIGS. 1–3, 5 and 6, the supply conduit 402 includes a pair of pivotal joint assemblies 405, 407. The joint assembly 405 pivotally interconnects lower and intermediate supply conduit sections 409, 411 for relative movement about the axis 210 (see FIG. 5 wherein the axis 210 is indicated by a center line, and FIG. 6, wherein the axis 210 is indicated by a point). The joint assembly 407 pivotally interconnects the intermediate conduit section 413 for relative movement about the axis 310 (see FIG. 5 wherein the axis 310 is indicated by a center line, and FIG. 6 wherein the axis 310 is indicated by a point). By this arrangement, the conduit sections 409, 411 are able to move concurrently with their associated relatively movable machine components, namely the frame structure 100 and the receptacle assembly 200, as these components pivot relatively about the axis 210. Similarly, the conduit sections 411, 413 are able to move concurrently with their associated relatively movable machine components, namely the housing structure 220 and the door 300, as these components pivot relatively about the axis 310.

The joint assemblies 405, 407 are formed from identical components. Referring to FIG. 9 wherein components of the joint assembly 405 are depicted, the associated supply conduit sections 409, 411 have aligned portions which extend along the pivot axis 210, and carry end flanges 419, 421, respectively. A resilient annular seal 415 is interposed between opposed faces 423, 425 of the flanges 419, 421, respectively, to establish a fluid-tight seal therebetween which will permit relative movement of the conduit sections 409, 411 about the axis 210. The seal 415 is preferably formed from a high molecular weight polyethylene which will remain resilient in the presence of ambient air temperatures as well as cryogenic temperatures. A pair of clamping U-shaped brackets 431 are provided for surrounding the flanges 419, 421 and the seal 415 to hold these components in alignment while permitting their relative movement about the axis 210. Threaded fasteners 427 extend through aligned holes 433 provided in end portions 435 of the brackets 431 and are secured by nuts 429 to clamp the end portions of the brackets 431 together. U-shaped grooves 439 are provided in curved portions 437 of the brackets 431 to surround and engage the flanges 419, 421 with the seal 415 clamped therebetween. The width of the grooves 439 are formed such that the brackets 431 serve to maintain the flanges 419, 421 in clamping engagement with the seal 415.

Referring to FIGS. 1–6, the recirculation system 400 includes not only the supply conduit 402 but also a withdrawal conduit 404 for evacuating cryogen gas from an upper portion of the rear part of the receptacle assembly 200, and a blower 410 for receiving cryogen gas from the withdrawal conduit 404 and delivering repressurized cryogen gas to the supply conduit 402. A variable speed drive motor 412 is provided for driving the blower 410. The blower 410 operates in a push-pull fashion to establish a high velocity flow of cryogen gas through the treatment chamber by (1) diminishing pressure within the withdrawal conduit 404 to effectively evacuate gas from the receptacle assembly 200, and (2)

by repressurizing the cryogen gas for delivery under pressure to the receptacle assembly 200 through the supply conduit 402 and the throwing wheel 350. A metering valve 450 (best illustrated in FIG. 6) is interposed in the supply conduit 402 for introducing a controlled flow of particulate media into the flow of pressurized cryogen which is being delivered through the supply conduit 402 to the throwing wheel 350. The metering valve 450 includes a vaned rotor 452 which is driven by a variable speed drive motor 454 (seen in FIG. 5) for dispensing a controlled flow of particulate media M into the supply conduit 402.

The recirculation system 400 also includes a separation system 500 for withdrawing particulates including particles of flash P and particulate media M from the receptacle assembly 200, and for ducting these particles to a three-stage separator unit 510. A flexible, accordian-folded bellows 506 is provided for ducting particulates from the compartment 262 into the separator unit 510. The bellows is preferably formed from an aluminized glass fiber material or other suitable material which will remain flexible and extensible in the manner of an accordian in the presence of ambient air temperatures as well as cryogenic temperatures.

As is best seen in FIG. 5, the separator unit 510 has a first or upper stage 512 which effectively removes large particles of flash P for delivery to a waste bin 514, a second or middle stage 522 which effectively withdraws reusable particulate media M for delivery to a hopper 524, and a third or lower stage 532 which ducts smaller particles P of flash and other waste particulates into the waste bin 514. A conventional vibratory drive system 516 is provided for effecting vibratory separation of the particulates P and M within the unit stages 512, 522, 532.

Figure 6:
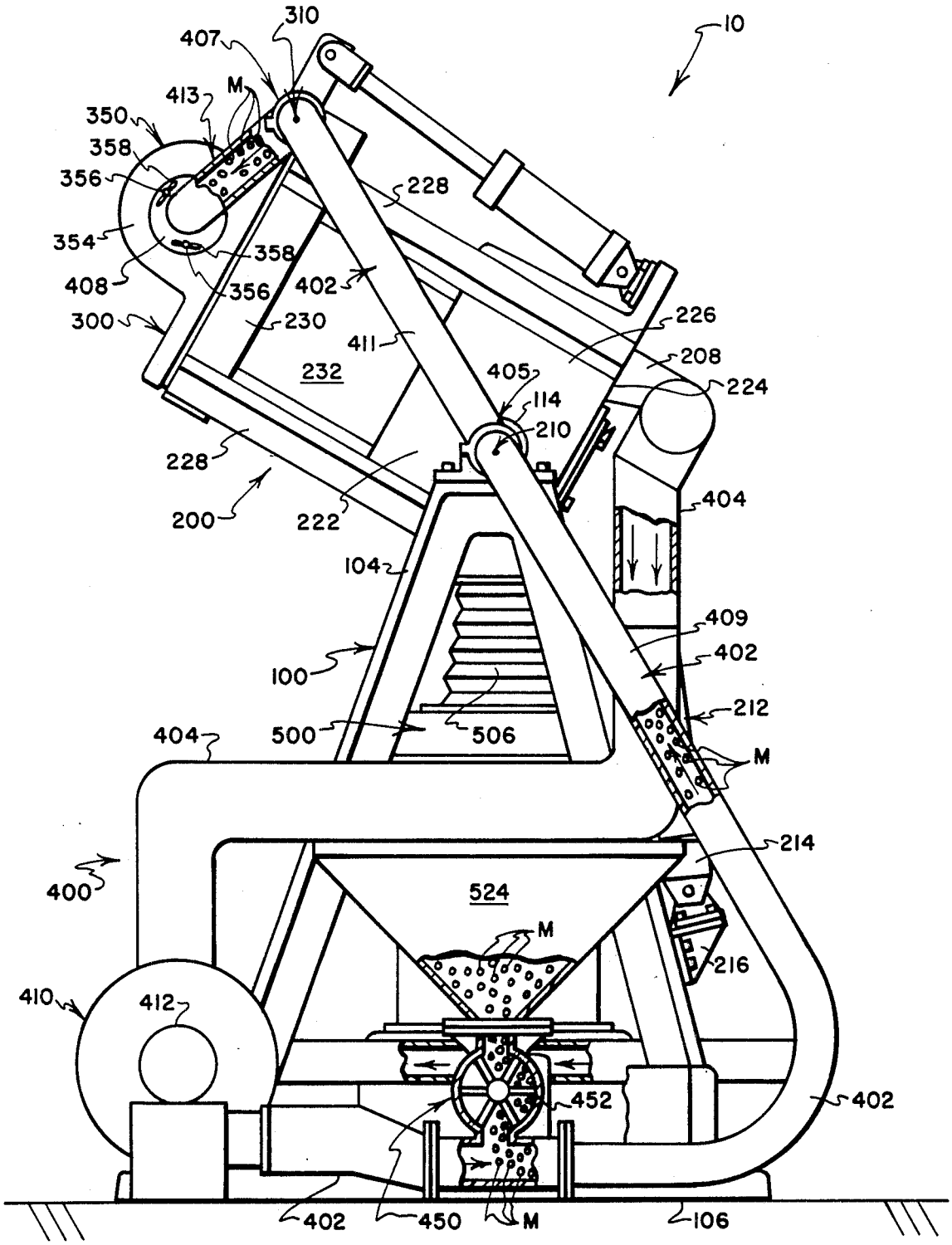
FIG. 6 is a side elevational view similar to FIG. 4 but with fewer portions of the machine removed or broken away and shown in cross section.

Referring to FIGS. 7 and 8, the supply conduit end formation 403 is tapered and is partially covered by a semi-circular shroud plate 406. Referring to FIG. 6, an annular plate 408 is welded about the periphery of the supply conduit 402 and is secured to the throwing wheel housing 354 by threaded fasteners 356. Slots 358 are formed in the annular plate 408 to enable the plate 408 to be rotated relative to the housing 354 so that the orientation of the tapered end formation 403 with respect to the housing 354 can be adjusted. This adjustment is effected by loosening the threaded fasteners 356, by rotating the annular plate 408 to reorient the tapered inner end formation 403 as desired, and by tightening the threaded fasteners 356 to secure the end formation 403 with respect to the housing 354. The purpose of adjusting the orientation of the tapered inner end formation 403 is to provide a degree of control with respect to the direction and manner in which particulate media is discharged from the throwing wheel 350 into the drum 250. The direction of discharge of media particles which are propelled by the throwing wheel 350 can, in this manner, be adjusted to aim these particles toward an upper wall portion of the drum 250, a lower wall portion of the drum 250, or in directions extending more closely along the central rotation axis 260.

In operation, the apparatus 10 is preferably put through an initialization procedure to ready it to receive a first charge of workpieces W to be deflashed if the apparatus 10 is being put into operation after having been shut down for any significant period of time. The initialization procedure is carried out by positioning the receptacle assembly 200 in its upwardly oriented position with the door 300 closed, as is shown in FIG. 2. Cryogen is introduced into the treatment chamber 290 through the valved conduit 330, and operation of the blower 410 is initiated to circulate cryogen throughout the closed system of the machine 10 and to purge the machine 10 of air and moisture, whereby the components of the machine 10 are prechilled and are thereby readied for a deflashing operation.

An actual deflashing operation is carried out by positioning the receptacle assembly 200 in its upwardly oriented position with the door 300 open, as is shown in FIG. 1, whereupon a charge of workpieces W to be deflashed is positioned in the treatment chamber 290. The door 300 is then closed, and system operation is begun. As is depicted schematically in FIGS. 4 and 5, during system operation a flow of cryogen gas and particulate media is delivered through the supply conduit 402 to the throwing wheel 350. The throwing wheel 350 projects a relatively high velocity flow of cryogen gas and media M into the treatment chamber 290 to impact workpieces W as the drum 250 is rotated to impart a tumbling action to the workpieces so that all flash-carrying surfaces of the workpieces W are exposed to the embrittling affect of the cryogen and the impact of the media particles M.

During rotation of the drum 250, a flow of particulates discharges from the treatment chamber 290 through the screened openings 258 into the compartment 262, and through the flexible conduit 506 into the separator assembly 510. At the same time, cryogen gas discharges from the treatment chamber 290 through the screened openings 258 into the compartment 262, and is ducted by the withdrawal conduit 402 to the blower 410. The blower 410 repressurizes the withdrawn cryogen gas and ducts it into the supply conduit 402 through which it travels at relatively high velocity back to the throwing wheel 350. The separator assembly 510 segregates reusable particulate media M and ducts it into the containment hopper 524, from where the media M flows under the influence of gravity and as controlled by the metering device 450 into the supply conduit 402 for return to the throwing wheel 350. Waste particulates including pieces of flash P and the like are ducted by the separator assembly 510 into the waste bin 514.

A feature of the described system lies in its capability during system design to be scaled upwardly or downwardly in size to provide apparatus of a desired capacity. In this regard, a drum 250 having an internal capacity of about 3 cubic feet is found to work well in deflashing a volume of about 1 cubic foot of workpieces.

In order to carry out a deflashing operation with maximum efficiency, such operating parameters as (1) the orientation of the axis of rotation of the drum 250 (normally oriented horizontally or tilted upwardly to within a range of about 0° to 30° from the horizontal), (2) the temperature within the receptacle assembly 200 (normally within the range of about +20° F. and −280° F.), (3) the speed of rotation of the drum 250 (normally within the range of about 0–60 rpm), (4) the speed of rotation of the throwing wheel 350 (normally within the range of about 1,000–10,000 rpm), (5) the speed of rotation of the blower 410 (normally within the range of about 1500–2000 rpm), (6) the shape, size and type of the particulate media M (normally polycarbonate particles of a selected uniform size), (7) the pattern of projection of particulate media M which is introduced into the treatment chamber 290, and the like, are preferably preset to correspond with optimum settings that have been predetermined through experimentation as being optimum for the particular workpieces to be deflashed. To the degree that these parameters are adjustable by operator controls, suitable commercially available control devices (not shown) are preferably provided to facilitate the setting and determination of appropriate parameters.

Once a deflashing operation has been completed, the flow of cryogen and particulate media through the system of the machine 10 is stopped by cutting off flow through the supply line 330, and by stopping the blower 410. The receptacle assembly 200 is tilted to its downwardly oriented position, and the door 300 is opened, as is shown in FIG. 3, whereupon the deflashed workpieces are discharged from the treatment chamber 290 into an awaiting receptacle (not shown). In preferred practice, the door 300 is kept open for as short a time as possible to minimize the escape of cryogen from the system of the machine 10 and to minimize the entry of ambient moisture into the system of the machine 10.

As will be apparent from the foregoing description, the system of the present invention has novel and improved features that include advances in both method and apparatus. The system includes a significant number of simplifications and a more efficient arrangement and utilization of components as compared with prior proposals. In operational tests, the system has been found to carry out deflashing procedures expeditiously and reliably with a wide variety of workpieces to be deflashed.

Although the invention has been described in its preferred form with a certain degree of particularity, it will be understood that the present disclosure of the preferred form has been made only by way of example, and that numerous changes in the details of construction and the combination and arrangements of parts and the like may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A cryogen shot blast deflashing apparatus, comprising:

(a) receptacle means including a drum-like container defining a treatment chamber for receiving workpieces to be deflashed and for rotating about an axis, frame means for supporting the container for rotation about said axis relative to the frame means, and drive means for rotating the container about said axis relative to the frame means to impart movement to workpieces contained within the treatment chamber;

(b) throwing wheel means for receiving a supply of particulate media and a flow of cryogen gas, for propelling media into the treatment chamber to impact workpieces which are being moved about within the treatment chamber, and for introducing a relatively high velocity flow of cryogen gas into the treatment chamber;

(c) cryogen supply means for introducing a flow of crygen into the treatment chamber for embrittling at least selected portions of the contents of the treatment chamber;

(d) cryogen recirculation means for withdrawing cryogen gas from the treatment chamber and for redelivering cryogen gas to the throwing wheel, the cryogen recirculation means including return conduit means for withdrawing cryogen gas from the treatment chamber, and supply conduit means for redelivering pressurized cryogen to the throwing wheel means, and a blower connected to the return conduit means for assisting in the withdrawl of cryogen gas from the treatment chamber and for pressurizing the withdrawn cryogen gas for return to the treatment chamber through the supply conduit means and the throwing wheel, whereby the blower and the throwing wheel means cooperate to establish a high velocity flow of cryogen gas through the treatment chamber to establish a high cooling rate which facilitates rapid embrittlement of workpiece flash; and, (e) media supply means for introducing a metered flow of particulate media into the flow of cryogen gas which is delivered to the throwing wheel means during operation of the apparatus, the media supply means including particulate media recirculation means for withdrawing reusable media from the treatment chamber and for introducing a metered flow of such withdrawn media into the supply conduit flow of pressurized cryogen gas to transport the same therewith to the throwing wheel means.

2. The deflashing apparatus of claim 1 wherein the media supply means includes adjustable metering means for effecting introduction of an adjustably controllable metered flow of particulate media into the flow of cryogen being delivered to the throwing wheel means.

3. The deflashing apparatus of claim 2 wherein:

(a) the media supply means additionally includes containment means for containing a supply of particulate media; and, (b) the metering means is connected to the containment means for receiving particulate media therefrom.

4. The deflashing apparatus of claim 3 wherein the metering means includes rotatable feeding means positioned beneath the containment means for receiving particulate media by gravity flow from the containment means and for delivering a flow of media into the supply conduit, with the rate of flow of media into the supply conduit being a function of the speed at which the rotatable feeding means is rotated, and variable speed drive means for rotating the rotatable feeding means at a controlled rate of speed to control the flow rate at which particulate media is delivered into the supply conduit.

5. The deflashing apparatus of claim 1 additionally including variable control means for selectively controlling the gas flow rate in the supply conduit means.

6. The deflashing apparatus of claim 1 wherein the cryogen supply means includes:

(a) supply means connected to a source of pressurized cryogen for introducing very low temperature cryogen gas into the treatment chamber during a deflashing operation; and, (b) sensing and control means for monitoring the temperature within the treatment chamber and for operating the supply means to introduce low temperature cryogen gas into the treatment chamber as may be required during a deflashing operation to maintain a desired temperature within the treatment chamber.

7. The deflashing apparatus of claim 6 wherein:

(a) the sensing and control means includes transducer means for providing a signal that is representative of the temperature within the treatment chamber;

(b) the supply means includes valved conduit means connected to a source of pressurized cryogen which is maintained at a temperature below that of a temperature which is desired to be maintained within the treatment chamber; and, (c) the sensing and control means is connected to the valved conduit means for operating the valved conduit means to introduce cryogen from said source into the treatment chamber when the signal provided by the transducer means indicates that the temperature within the treatment chamber is higher than the desired temperature.

8. The deflashing apparatus of claim 1 wherein the throwing wheel includes:

(a) a vaned rotor for centrifugally propelling particulate media into the treatment chamber;

(b) variable speed drive means for controlling the speed of rotation of the vaned rotor; and, (c) means for controllably ducting a supply of cryogen gas and particulate media into selected central portions of the vaned rotor.

9. The deflashing apparatus of claim 1 wherein the drive means includes variable speed drive means for driving and controlling the speed of rotation of the drum-like container, and connection means establishing a pivotal connection between the housing and the frame means for enabling the housing to move relative to the frame means to selectively orient the axis of rotation of the container.

10. The deflashing apparatus of claim 9 wherein the receptacle means includes a housing which defines a closed compartment extending about at least a portion of the container, and the container has screened openings therethrough to permit the passage of particulates from the treatment chamber into the compartment.

11. The deflashing apparatus of claim 10 additionally including:

(a) separating means for segregating reusable media from other particulates, and conduit means for ducting particulates from the compartment to the separating means; and, (b) means for ducting reusable particulate media from the separating means into the flow of cryogen gas being delivered to the throwing wheel means.

12. A cryogen deflashing apparatus comprising:

(a) tumbling means including a frame structure rotatably supporting a drum-like container defining a treatment chamber for rotation about an axis to impart a tumbling action to contents of the treatment chamber;

(b) throwing wheel means for receiving a supply of particulate media and for propelling the media into the treatment chamber to impact contents of the treatment chamber while the contents are being tumbled about by rotation of the container during operation of the apparatus;

(c) cryogen supply means for introducing a flow of cryogen into the treatment chamber for embrittling at least selected portions of the contents of the treatment chamber;

(d) cryogen recirculation means for withdrawing cryogen gas from the treatment chamber and for redelivering cryogen gas under pressure to the treatment chamber through the throwing wheel means during operation of the apparatus, including withdrawal conduit means for withdrawing cryogen gas from the treatment chamber and supply conduit means for redelivering pressurized cryogen to the throwing wheel means; and, a blower connected to the withdrawal conduit means and to the supply conduit means for evacuating cryogen gas from the treatment chamber thorough the withdrawal conduit means for pressuring such withdrawn cryogen gas, and for delivering pressurized cryogen gas to the throwing wheel means through the supply conduit means; and, (e) media supply means for introducing a metered flow of particulate media into the pressurized flow of cryogen gas which is delivered to the throwing wheel means during operation of the apparatus, including particulate media recirculation means for withdrawing reusable particulate media from the treatment chamber and for introducing such withdrawn particulate media into the supply conduit flow of cryogen gas for conveyance thereby and return therewith through wheel to the treatment chamber.

13. The deflashing apparatus of claim 12 wherein the media supply means includes separator means for receiving a flow of particulates which is withdrawn from the treatment chamber, for segregating reusable particulate media from such flow, and for delivering segregated particulate media into a containment means, and the containment means includes a hopper into which segregated particulate media from the separator means together with an additional quantity of particulate media may be contained for use in deflashing operations.

14. The deflashing apparatus of claim 12 wherein:

(a) the media supply means includes metering means for effecting introduction of an adjustably controllable metered flow of particulate media into the pressurized flow of cryogen being delivered to the throwing wheel means;

(b) the media supply means additionally includes containment means for containing a supply of particulate media; and, (c) the metering means is connected to the containment means for receiving particulate media therefrom.

15. The deflashing apparatus of claim 14 wherein the metering means includes rotatable feeding means positioned beneath the containment means for receiving particulate media by gravity flow from the containment means and for delivering a flow of media into the supply conduit, with the rate of flow of media into the supply conduit being a function of the speed at which the rotatable feeding means is rotated, and variable speed drive means for rotating the rotatable feeding means at a controlled rate of speed to control the flow rate at which particulate media is delivered into the supply conduit.

16. The deflashing apparatus of claim 15 additionally including media recirculation means for receiving a flow of particulates which are withdrawn from the treatment chamber, for segregating reusable particulate media from such flow, and for delivering segregated media into the containment means.

17. The deflashing apparatus of claim 12 wherein:

(a) the tumbling means includes a housing which rotatably supports the rotatable container for rotation about said axis of rotation;

(b) the housing defines a closed compartment extending about at least a portion of the container;

(c) separating means is provided for segregating reusable media from other particulates;

(d) conduit means is provided for ducting particulates from the compartment to the separating means; and, (e) duct means is provided for ducting reusable particulate media from the separating means into the flow of cryogen gas being delivered to the throwing wheel means.

18. A cryogen shot blast deflashing apparatus, comprising:

(a) an upstanding frame;

(b) a receptacle assembly supported by the upstanding frame;

(c) the receptacle assembly including container means which defines a treatment chamber for receiving workpieces, which has an access opening for enabling workpieces to be charged into and discharged from the treatment chamber, and which is mounted for movement relative to the upstanding frame;

(d) container drive means for moving the container means relative to the frame to impart movement to workpieces which have been charged into the treatment chamber;

(e) the receptacle assembly additionally including a housing enshrouding at least portions of the container means and having closure means mounted for movement between positions wherein the closure means selectively opens and closes the access opening of the container means;

(f) throwing wheel means carried by the receptacle assembly for projecting particulate media into the treatment chamber for impacting workpieces contained therein;

(g) containment means for containing a supply of particulate media;

(h) cryogen recirculation means including withdrawal conduit means connected to the receptacle assembly for withdrawing cryogen gas from the treatment chamber, supply conduit means connected to the throwing wheel means for delivering cryogen under pressure to the throwing wheel means, and blower means connected to the withdrawal conduit means and to the supply conduit means for evacuating cryogen gas from the treatment chamber through the withdrawal conduit means, for pressurizing such withdrawn cryogen gas, and for delivering such pressurized cryogen gas to the throwing wheel means through the supply conduit means; and, (i) metering means connected to the supply conduit means and to the containment means for introducing a metered flow of particulate media from the containment means into the flow of cryogen being delivered through the supply conduit means to the throwing wheel means.

19. The deflashing apparatus of claim 18 additionally including separator means for receiving a flow of particulate materials which is withdrawn from the treatment chamber, for segregating reusable particulate media from such flow, and for delivering such segregated particulate media into the containment means.

20. The deflashing apparatus of claim 18 wherein:

(a) the container means includes a rotatable drum and drive means for rotating the drum relative to the housing about an axis of rotation;

(b) the drum has a substantially cylindrical outer wall which extends from an inner end to an outer end, with the inner end having an end wall that closes one end of the drum, and with the outer end defining the access opening;

(c) the axis of rotation of the drum extends:

(i) substantially coaxially with respect to the cylindrical outer wall of the drum;

(ii) substantially centrally through the inner end wall; and, (iii) through the access opening defined by the outer end of the drum;

(d) the throwing wheel means is carried on the closure means and is positioned to project particulate media through the access opening into the drum;

(e) the housing defines a closed compartment extending about at least a portion of the drum; and, (f) the drum has screened openings therethrough to permit the passage of particulates from the treatment chamber into the compartment.

* * * * *